US011377243B2

(12) United States Patent
Rivola et al.

(10) Patent No.: US 11,377,243 B2
(45) Date of Patent: Jul. 5, 2022

(54) MACHINE FOR FORMING FILTER BAGS FOR INFUSION PRODUCTS

(71) Applicant: I.M.A. INDUSTRIA MACCHINE AUTOMATICHE S.p.A., Ozzano Dell'Emilia (IT)

(72) Inventors: Sauro Rivola, Ozzano Dell'Emilia (IT); Andrea Sermenghi, Ozzano Dell'Emilia (IT); Mauro Bianchi, Ozzano Dell'Emilia (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 0 days.

(21) Appl. No.: 16/973,683

(22) PCT Filed: Jun. 19, 2019

(86) PCT No.: PCT/IB2019/055150
§ 371 (c)(1),
(2) Date: Dec. 9, 2020

(87) PCT Pub. No.: WO2019/244064
PCT Pub. Date: Dec. 26, 2019

(65) Prior Publication Data

US 2021/0253285 A1 Aug. 19, 2021

(30) Foreign Application Priority Data

Jun. 20, 2018 (IT) ..... 102018000006476

(51) Int. Cl.
*B65B 29/02* (2006.01)
*B65B 29/04* (2006.01)
(Continued)

(52) U.S. Cl.
CPC ..... *B65B 29/028* (2017.08); *B65B 29/04* (2013.01); *B65B 41/16* (2013.01); *B65B 41/18* (2013.01);
(Continued)

(58) Field of Classification Search
CPC ..... B65B 11/48; B65B 29/02; B65B 29/028; B65B 29/04; B65B 41/16; B65B 41/18; B65B 51/225; B65B 59/02; B65H 2801/69
(Continued)

(56) References Cited

U.S. PATENT DOCUMENTS 4,075,816 A * 2/1978 Holt et al. ..... B65B 41/02 53/389.3
5,871,789 A * 2/1999 Romagnoli ..... B65B 29/04 53/134.2
(Continued)

FOREIGN PATENT DOCUMENTS

CN 1161904 A 10/1997
CN 1692057 A 11/2005
(Continued)

OTHER PUBLICATIONS

Chinese Office Action dated Oct. 21, 2021 from counterpart Chinese Patent Application No. 201980040489.6.
(Continued)

*Primary Examiner* — Stephen F. Gerrity
(74) *Attorney, Agent, or Firm* — Shuttleworth & Ingersoll, PLC; Timothy Klima

(57) ABSTRACT

A machine for making filter bags of different shapes for infusion products includes: a wheel defining a work surface and rotating about a relative axis; feed stations for placing tags on the work surface, a continuous thread, along a weave path, and a strip of filter material superposing the weave of
(Continued)

thread and the tag. A sealing device is located downstream of the feed stations for sealing between the thread, tag and strip of filter material. A feed device moving the strip along a feed line is positioned downstream of the wheel. A station introduces a dose of infusion product in bag and closes the bag. The feed device has two feed rollers, for unwinding the strip, controlled by a control system for adjusting the speed of rotation of the feed rollers as a function of the length of the filter material needed to form the bag.

13 Claims, 5 Drawing Sheets

(51) Int. Cl.

| | |
|---|---|
| ***B65B 41/16*** | (2006.01) |
| ***B65B 41/18*** | (2006.01) |
| ***B65B 51/22*** | (2006.01) |
| ***B65B 59/02*** | (2006.01) |
| ***B65H 23/038*** | (2006.01) |

(52) U.S. Cl.
CPC ..... *B65B 51/225* (2013.01); *B65B 59/02* (2013.01); *B65H 23/038* (2013.01); *B65H 2701/191* (2013.01)

(58) Field of Classification Search
USPC ..... 53/51, 64, 134.2, 562
See application file for complete search history.

(56) References Cited

U.S. PATENT DOCUMENTS

| | | | | |
|---|---|---|---|---|
| 7,204,794 | B2 * | 4/2007 | Rea et al. ..... | B65B 29/04 53/134.2 |
| 8,500,617 | B2 * | 8/2013 | Tsuji et al. ..... | B65B 51/225 53/134.2 |
| 2004/0226263 | A1 * | 11/2004 | Romagnoli ..... | B65B 29/028 53/134.2 |

FOREIGN PATENT DOCUMENTS

| | | | | | |
|---|---|---|---|---|---|
| GB | 1399646 | A | * | 7/1975 | ..... B31B 70/148 |
| IT | B0950574 | A1 | | 6/1997 | |
| WO | 2009141867 | A1 | | 11/2009 | |
| WO | 2009141868 | A1 | | 11/2009 | |
| WO | 2010029652 | A1 | | 3/2010 | |

OTHER PUBLICATIONS

International Search Report and Written Opinion dated Sep. 30, 2019 from counterpart International Patent Application No. PCT/IB2019/055150.

* cited by examiner

MACHINE FOR FORMING FILTER BAGS FOR INFUSION PRODUCTS

This application is the National Phase of International Application PCT/IB2019/055150 filed Jun. 19, 2019 which designated the U.S.

This application claims priority to Italian Patent Application No. 102018000006476 filed Jun. 20, 2018, which application is incorporated by reference herein.

TECHNICAL FIELD

This invention relates to a machine for making filter bags for infusion products, such as, for example, tea, coffee, chamomile and the like.

BACKGROUND ART

The filter bags according to the invention may be of the so-called traditional type, that is to say, single-lobed or double-lobed filter bags (that is, with a flat extension) or also the pyramidal filter bags (that is, with a substantially three-dimensional extension).

Both types of filter bags have as common elements, as well as a piece of filter material paper and a dose of infusion product, a stretch of thread which is joined, on one side, to the piece of filter material and, on the other side, to a gripping tag.

The thread is usually positioned around the filter bag according to a predetermined path and associated with the filter bag with joining points (for example by sealing) of a differentiated type: strong points if the join must be maintained even during use or light points if that part of the thread has to be detached before use.

One of the prior art solutions of machines for forming the above-mentioned filter bags of a pyramidal type is described in patent document EP 1 572 539 by the same Applicant.

This machine for making pyramidal filter bags comprises as the base structure:

a wheel defining a cylindrical work surface and rotating about its own axis in such a way as to define a working path having a circular feed direction;

a first feed station for depositing individual tags, in phase, on the cylindrical work surface in a predetermined zone of the working path;

a second feed station for feeding, along a weave path, a continuous thread on the cylindrical work surface, starting from a predetermined zone downstream of the zone for depositing the individual tags with reference to the feed direction; the above-mentioned weave path of the thread is also obtained thanks to the presence of protruding pins present on the cylindrical work surface;

a third feed station for feeding a continuous strip of filter material along the cylindrical work surface superposing the weave of thread and the tag and deposited downstream relative to the second feed station;

a first group of sonotrodes, interposed between the second and the third feed station, configured for making a first series of seals between the thread and the tag (in particular programmed to obtain strong type seals);

a second group of sonotrodes, positioned downstream of the first group of sonotrodes and at the cylindrical work surface in which the strip of filtering material is deposited; the second group of sonotrodes is configured to form both a plurality of seals between the stretch of thread, arranged according to the weave path and present under the strip of filter material, and the strip, and between the strip and the tag (in this case the second group of sonotrodes is configured to obtain light type seals);

a station for completion of the filter bag already provided with the tag and the thread, positioned downstream of the wheel, and configured for forming geometrically the filter bag (pyramidal or tetrahedral shape), for introducing a dose of infusion product and closing the filter bag in its shape.

This type of machine, which in fact has good performance levels and reliability, is, however, constrained to the formation of a single type of filter bag, tetrahedral in shape and with fixed dimensions, and therefore lacks operational flexibility which is currently required for this type of automatic machine in view of the increasingly greater needs to change the size required by the market.

Another drawback of the machine is due to the complexity of the kinematic units which connect the rotation (continuous or step-by-step) of the wheel to the movements of the groups of sonotrodes (radial relative to the work surface) and with the relative variable times and pressure (resulting from the formation of strong or light joining points) and also due to the curved surface on which they must work in a punctiform manner.

This structure, in addition to the high cost, which impacts on the machine cost, may require frequent checks to be carried out in order to maintain the correct functionality.

DISCLOSURE OF THE INVENTION

The aim of this invention is to provide a machine for making filter bags for infusion products, such as, for example, tea, coffee and camomile and the like, which overcomes the above-mentioned drawbacks.

In particular, the aim of the invention is to provide a machine for making filter bags for infusion products which is able to increase the production flexibility with the formation of filter bags of different sizes and different geometrical shapes without modifying the dimensions of the machine.

A further aim of the invention is to provide a machine for making filter bags for infusion products which is able to simplify and reduce the operational components around the forming wheel, maintaining a high production quality and a high speed of execution.

Said aims are fully achieved by the machine for forming filter bags for infusion products, such as, for example, tea, coffee, chamomile and the like, according to this invention as characterised in the appended claims.

BRIEF DESCRIPTION OF DRAWINGS

The technical features of the invention will become more apparent from the following detailed description of a preferred, non-limiting embodiment of it, illustrated by way of example in the accompanying drawings, in which.

DETAILED DESCRIPTION OF PREFERRED EMBODIMENTS OF THE INVENTION

Figure 1:
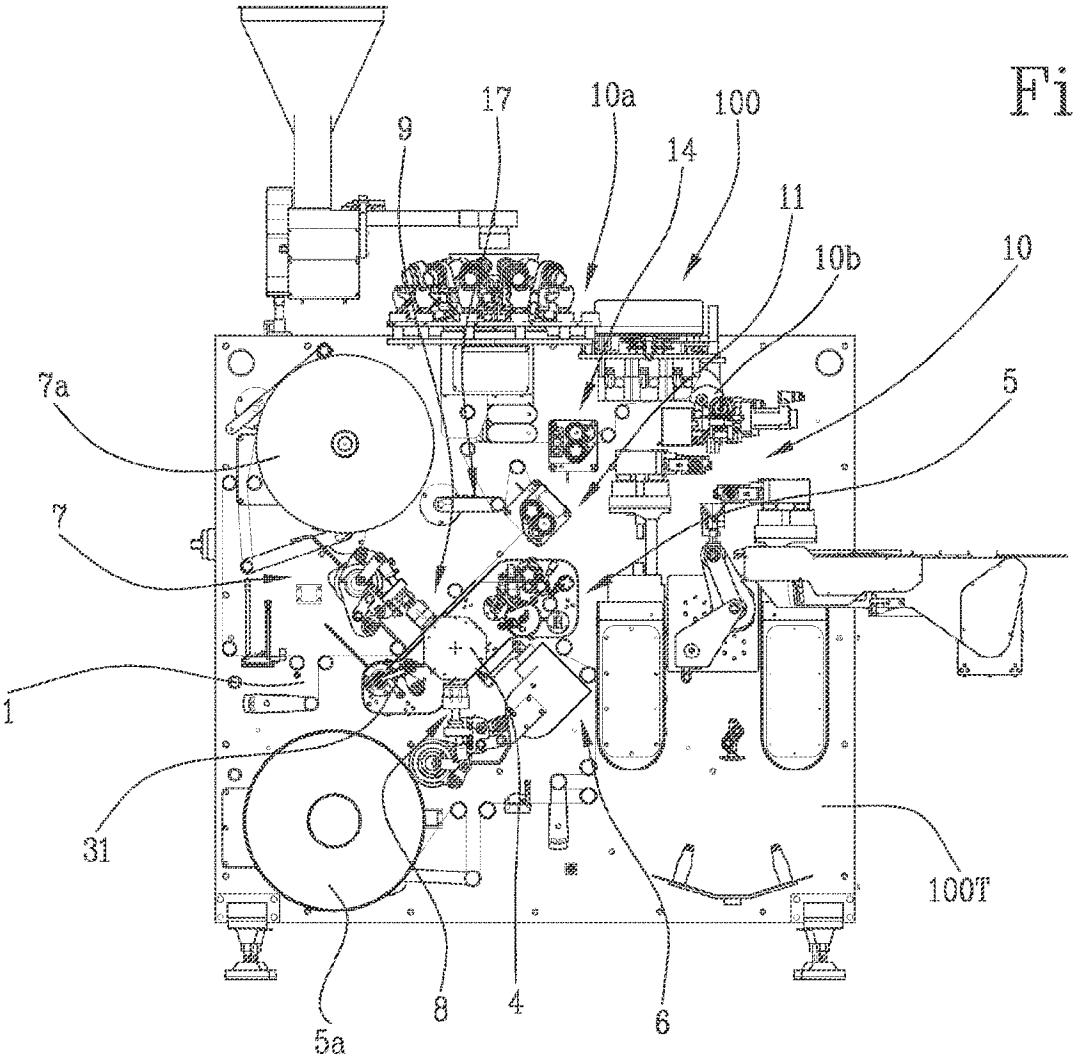
FIG. 1 illustrates a front view of a machine for forming filter bags for infusion products according to the invention.
Figure 2:
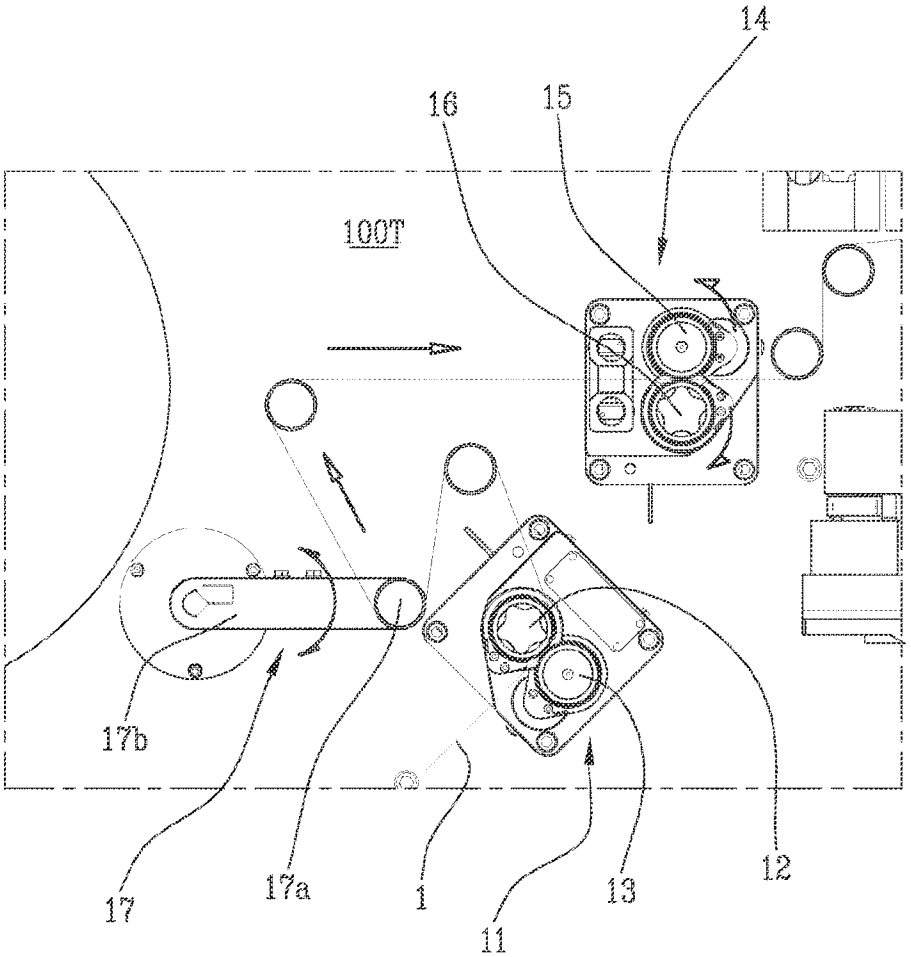
FIG. 2 illustrates an enlarged first detail of FIG. 1 and in particular a first and a second device for feeding a strip of filter material.

With reference to the accompanying drawings, and in particular to FIG. 1, the machine according to the invention, labelled 100 in its entirety, is used for forming filter bags for infusion products.

As described below, the machine 100 is configured to form both the three-dimensional filter bags such as the pyramidal bags and the so-called traditional single-lobed or double-lobed filter bags with a rectangular shape.

Irrespective of the above-mentioned shape, each filter bag is obtained on the machine 100 starting from a piece of filter material to which is associated a thread 2 for connection with a gripping tag 3.

Figure 4:
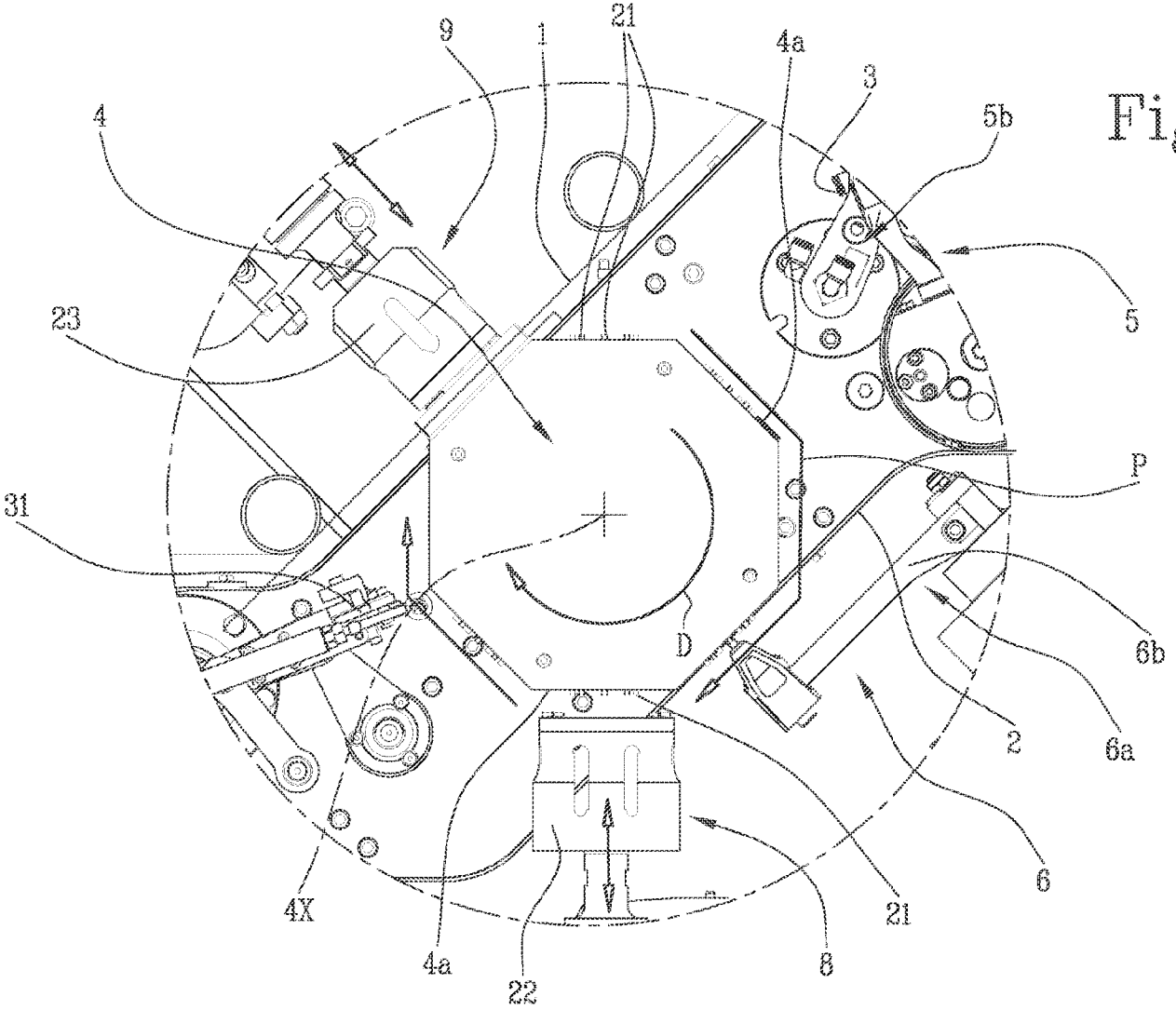
FIG. 4 illustrates an enlarged third detail of FIG. 1 and in particular an operating wheel for feeding a strip of filter material.

As illustrated, the machine 100 for forming the filter bags comprises a wheel 4 defining a work surface (FIG. 4).

The wheel 4 is rotary about its own axis 4X in such a way as to define a working path P having a circular feed direction D (in clockwise direction in this case).

The machine 100 also comprises a first feed station 5 for depositing individual tags 3, in phase, on the work surface in a predetermined depositing zone of the working path P.

As illustrated, the machine 100 comprises a second feed station 6 for feeding, along a weave path, the continuous thread 2 on the work surface, starting from a predetermined zone downstream of the zone for depositing the individual tags 3 with reference to the feed direction D of the wheel 4.

The machine 100 also comprises a third feed station 7 for feeding a continuous strip 1 of filter material on the work surface superposing the weave of thread 2 and the tag 3. The feed station 7 is positioned downstream of the second feed station 6 with reference to the feed direction D of the wheel 4.

Again as illustrated, the machine 100 comprises sealing means 8, 9, located downstream of the first feed station 5 and the second feed station 6 with reference to the feed direction D of the wheels 4, configured for making seals between the thread 2, the tag 3 and the strip 1 of filter material.

Again as illustrated, the machine 100 comprises at least a first feed device 11 for moving the strip 1 of filter material along a feed line L1 and located downstream of the operating wheel 4 with reference to the feed direction L1 of the strip 1 of filter material.

Again as illustrated, the machine 100 comprises a station 10 for completing the filter bag equipped with the tag 3 and thread 2, positioned downstream of the feed device 11 with reference to the feed direction D of the strip 1 of filter material, and configured for forming the filter bag, for introducing a dose of infusion product in the filter bag formed and closing the filter bag containing the dose of infusion product (in its final shape which may be three-dimensional or rectangular).

As illustrated, the first feed device 11 has two first feed rollers 12, 13 (positioned side by side) for unwinding in a controlled manner, that is, variable, the quantity of strip 1 of filter material to be placed on the work surface of the wheel 4.

The two first feed rollers 12 and 13 are controlled by a control system configured to adjust by means of a motor the rotation speed of the two first feed rollers 12, 13 as a function of the length of the piece of filter material needed to form a filter bag of desired size.

Preferably, the two first feed rollers 12, 13 can be operated with an alternating or step-by-step rotary movement. It should be noted that the first feed device makes it possible to modify the dimensions of the piece of filter material and therefore of the type of filter bag, without altering the steps and the process for assembling the components of the filter bag (piece of filter material, thread and tag) both on the operating wheel and, subsequently, in the completion station.

It should be noted that the first station 5 for feeding the tags 3 comprises a reel system 5*a* for storing a continuous strip of tags 3 fed to a unit 5*b* for cutting and positioning a single tag 3 on the operating wheel 4.

Preferably, the second station 6 for feeding the continuous thread 2 comprises a spool-type magazine (not illustrated) which feeds a unit 6*a* for positioning the thread 2 on the operating wheel 4 having an arm 6*b* for arranging the thread 2 along the predetermined path or pattern on the wheel 4.

Figure 5:
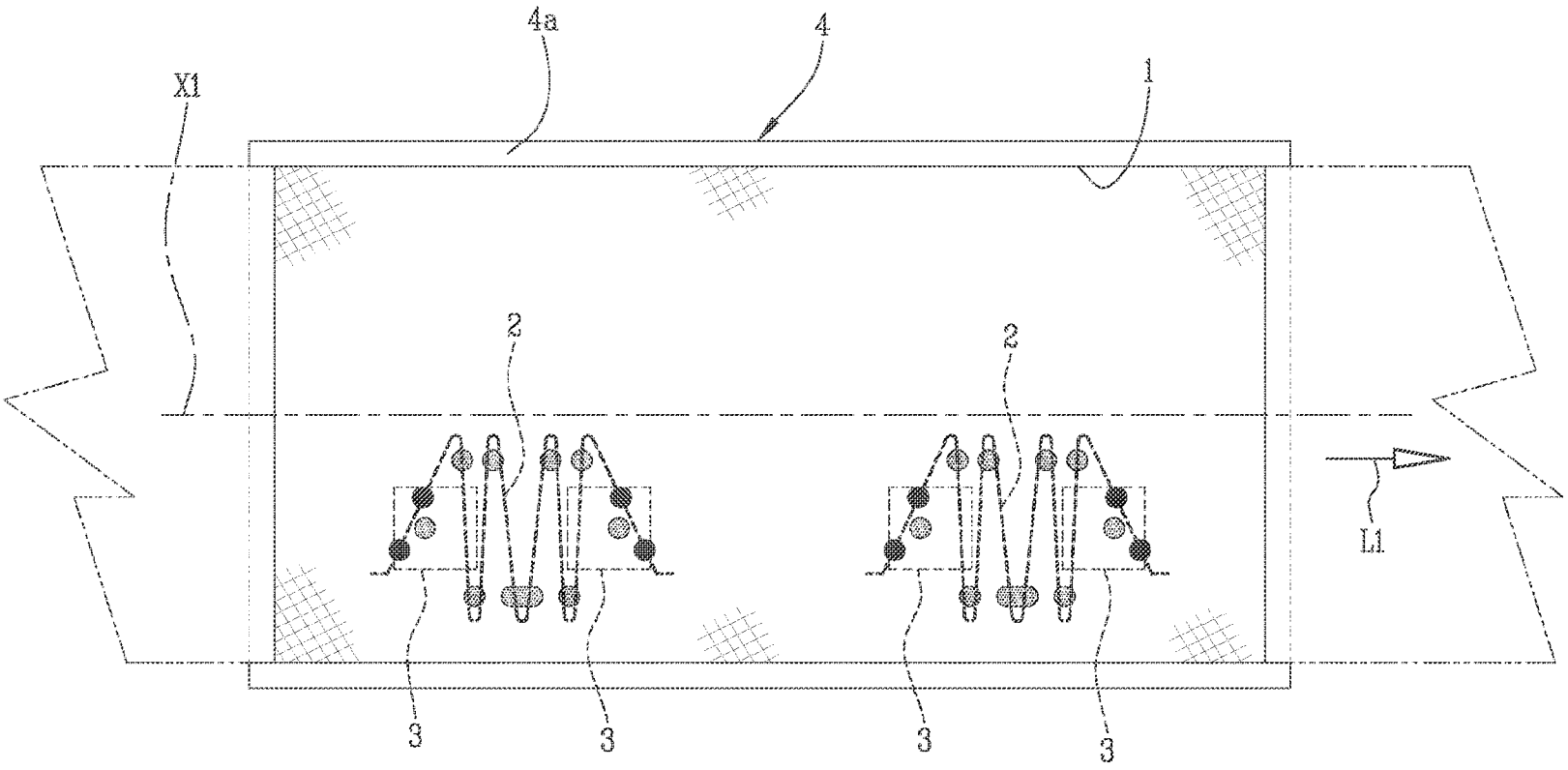
FIG. 5 illustrates a schematic top plan view, with some parts cut away to better illustrate others, of an enlarged fourth detail of FIG. 4 and in particular a work surface of the operating wheel.

A weave path of the thread 2 is illustrated, by way of non-limiting example, in FIG. 5.

It should also be noted that the third station 7 for feeding the strip 1 of filter material comprises a reel system 7*a* for storing a continuous strip 1 of filter material unwound (by suitable rollers) until reaching the operating wheel 4.

It should be noted that between the sealing means 8, 9 there is a cutting element 31 configured to separate the weave portion of thread 2 present under the continuous strip 1 of filter material from the remaining continuous thread 2.

The above-mentioned completion station 10 comprises at least one doser 10*a* of infusion product, a substation 10*b* for forming and closing the strip 1 of filter material in a closed tubular configuration during its movement along a vertical feed axis 10Z. Along its downward movement, the strip 1 of filter material is intercepted by a series of closing stations (not illustrated in detail) in order to form the bottom of the filter bag, the head of the filter bag (after the introduction of the dose of infusion product) and unload the filter bag thus formed.

The filter bag size (tetrahedral or rectangular) will be a function of the type, arrangement and programmed activation of the sealing systems along the downwards vertical axis of the continuous strip 1 of filter material and also (as described in more detail below) of the position of arrival of the continuous strip 1 of filter material to the forming station 10*b*.

Two examples of stations for completion of a filter bag with a different geometrical configuration are illustrated in patent documents EP 1 572 539 and EP 2 563 671 in the name of the same Applicant.

It should be noted that the strip 1 of filter material extends directly from the third station 7 for feeding the strip 1 of filter material (that is, from the reel 7*a*) to the first feed device 11, which is movable in an alternating or stepwise fashion, passing through the wheel 4 along a line L1 for feeding the strip 1 of filter material coinciding with a centre line axis X1 of the strip 1 of filter material.

The machine 100 comprises a second feed device 14 for moving the strip 1 of filter material, interposed between the first feed device 11 and the forming station 10.

The second feed device 14 having two second rollers 15, 16 for feeding the strip 1 of filter material configured for feeding and positioning, in a controlled manner, the strip 1 of filter material in the completion station 10.

In light of this, the first feed device 11 has the two first rollers 12, 13 rotating in an alternating or stepwise fashion, whilst the second device 14 has the two second rollers 15, 16 which can be operated with a continuous rotary movement.

This difference in motion of the two pairs of rollers of the first 11 and second 14 feed devices makes it possible to adapt the operation of the operating wheel 4 and the respective stations for the thread 2 and the tag 3 with possible adaptation of the size of the piece of filter material to be used, for the operation of the completion station 10 (usually with higher operating speed).

The first feed device 11 comprises the two first rollers 12, 13, parallel to each other and extending in a horizontal direction. The two first rollers are supported by a frame in which there is a drive unit for at least one of the first rollers. The drive unit is connected to a unit which controls the stepwise movement of the first rollers 12 and 13 for modulating the feed of the continuous strip 1 of filter material.

The second feed device 14 comprises the two second rollers 15, 16, parallel to each other and extending in a horizontal direction. The two second rollers are supported by a frame in which there is a drive unit for at least one of the second rollers. The drive unit is connected to a unit which controls the continuous movement of the second rollers 15 and 16 to control the feeding of the continuous strip 1 of filter material towards the station 10 for completing the filter bag.

As illustrated, the machine 100 also comprises a compensating device 17 for modulating the feeding of the strip 1 of filter material.

In light of this, the compensating device 17 is positioned between the first feed device 11 and the second feed device (14) for modulating the feeding of the feed strip 1 of material between the two devices 11, 14 as a function of the different speeds for feeding the strip 1 of filter material of the first 11 and the second 14 feed device.

It should be noted that the compensating device 17 comprises a roller 17*a* for intercepting the continuous strip 1 of filter material. The roller 17*a* is rotatably idle and connected to a pendulum arm 17*b* articulated to the machine frame 100T.

The arm 17*b* is controlled in its pendulum movement in such a way as to modify the extension of the strip of filter material between the first and second feed device 11 and 14 as a function of the operational feeding requirements (in short, the device creates a sort of buffer for the second feed device 14 without affecting the step movement of the first feed device 11).

As illustrated, the machine 100 comprises a device 18 for transferring the strip 1) of filter material to move transversely the strip 1 of filter material being fed, that is to say, modifying the position of a centre-line axis X1 of the strip 1 of filter material in such a way that the centre-line axis X1 of the strip 1 of filter material coincides with a working line on the work surface of the wheel 4.

It should be noted that the working line is parallel to the feed line L1 of the strip 1 of filter material and is defined as a function of the size of the desired filter bag. In light of this, the translation device 18 is interposed between the first feed device 11 and the second feed device 14 (and subsequently the compensation device 17) and is configured to be activated when changing over to a different size of filter bags to be formed.

Preferably, the transfer device 18 comprises at least a transfer roller 19, 20 articulated to a unit 30 for moving and intercepting the strip 1 of filter material being fed.

In light of this, the angular rotation of the at least one transfer roller 19, 20 is designed to modify the position of the centre-line axis X1 of the strip 1 of filter material.

Figure 3:
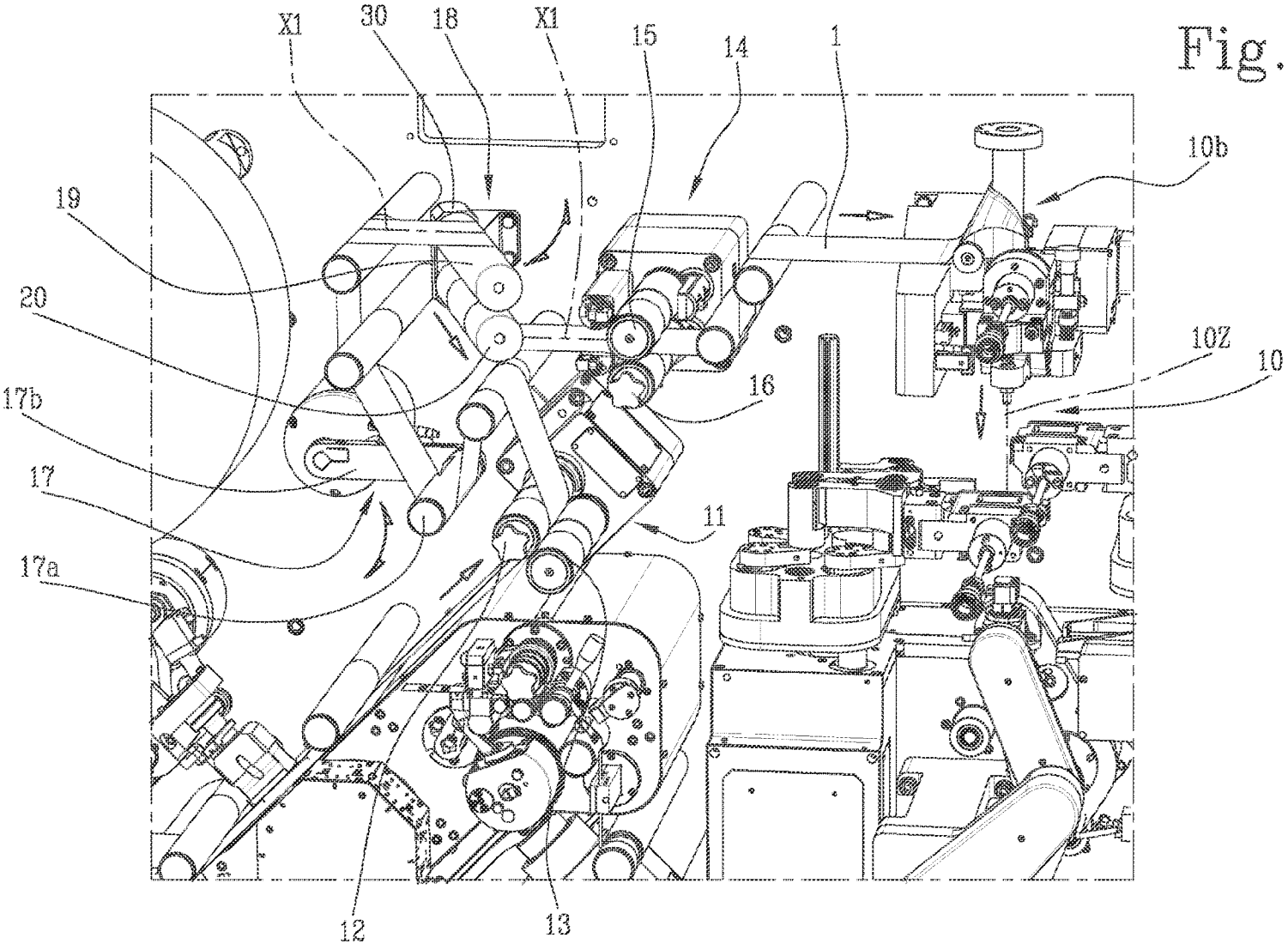
FIG. 3 illustrates an enlarged second detail of FIG. 1 and in particular a first and a second device for feeding a strip of filter material and a transfer device.

More in detail, the transfer device 18 comprises a pair of transfer rollers or shafts 19, 20 with a fixed axis which are superposed and articulated to a unit 30 for movement of the shafts 19, 20 between a non-operating position, wherein the shafts 19, 20 are spaced apart by a path for passage of the strip 1 of filter material, and an operating position wherein the shafts 19, 20 are positioned along the path of the strip 1 of filter material, in such a way as to modify the passage of the strip 1 of filter material passing through the shafts 19, 20 configured to move transversely the strip 1 of filter material being fed (FIG. 3).

In other words, the pair of shafts 19 and 20 has an adjustment system (for example, a shared supporting pin with vertical articulation extension) which is able to move them to a position such that it becomes a part of the path of the continuous strip 1 of filter material when required by the machine set up.

The pair of shafts 19 and 20 is positioned with their axes of extension inclined with respect to axes of rotation of the first and second rollers 12, 13 and 14, 15 of the first and second feed devices 11 and 14.

In light of this, the continuous strip 1 of filter material is wound first on the upper shaft 19 and then enters the lower shaft 20, forming a sort of "Z" path.

Thanks to the unit 30 for moving the pair of shafts 19, 20 it is possible to modify the angle of inclination of the pair of shafts 19, 20 (also with a manual action by the operator) in such a way as to slide the continuous strip 1 of filter material along the fixed surfaces of the shafts 19, 20 and, consequently, modify the position of the centre-line axis X1 of the strip 1 of filter material relative to its feed line L1.

As illustrated (FIGS. 1, 4), the wheel 4 has a prismatic shape in such a way as to define a plurality of individual work surfaces 4*a* in succession about the axis 4X of rotation.

In light of this, each single work surface 4*a* is flat in extension in such a way as to move, in sequence, to the individual first 5, second 6 and third 7 feed stations.

Preferably, but without limiting the invention, the wheel 4 has an octagonal shape, in cross section, in such a way as to form eight independent work surfaces 4*a*.

Preferably, each work surface 4*a* has a plurality of projecting reference pins 21 for the extension of the weave path of the thread 2.

Again as illustrated, the machine 100 comprises first sealing means 8, interposed between the second 6 and the third 7 feed station, designed for making a first series of seals between thread 2 and tag 3.

Moreover, the machine 100 comprises second sealing means 9, located downstream of the first sealing means 8, with reference to the feed direction D of the wheel 4, and configured for making a plurality of seals between a portion of thread 2, positioned according to the weave path, and the strip 1 of filter material, and between the strip 1 of filter material and the tag 3.

Thanks to this structure, each first 8 and second 9 sealing means is composed of a corresponding single head 22, 23 for ultrasonic sealing, each acting on a corresponding work surface 4*a* of the polygonal wheel 4 which each time it is brought forward in front of the single head 22, 23.

In other words, the presence of individual and flat work surfaces allows all the sonotrodes necessary to make the joining points (light or strong) to be structured with just two single heads wherein each groups together two or more sonotrodes operating with a rectilinear and radial movement relative to the axis 4X of the wheel 4: this feature makes it possible to obtain an excellent quality of the joining points combined with a high performance speed.

It should also be noted that the above-mentioned control system is operatively associated with a memory on which are stored a plurality of settings for a respective plurality of speeds of rotation of the two first feed rollers 12, 13. The preset aims with numerous advantages are achieved thanks to a machine structured in this way.

The presence of the first feed device makes it possible to quickly and safely modify the dimensional size of the piece of filter material which will form the filter bag.

The presence of the second feed device allows a high production speed to be maintained in the station for completion of the filter bag without affecting the operating speed of the steps to be performed on the operating wheel.

The presence of the transfer device (which is movable) makes it possible to modify the position of the continuous strip of filter material as a function of the type of filter bag to be completed and therefore of the position of the seals to be made in the completion station.

The use of a polygonal wheel improves the quality of the positioning of the components to be joined with a kinematic simplification of the operating components of the various stations.

The invention claimed is:

1. A machine for making filter bags for infusion products, each filter bag including a piece of filter material to which is associated a tie thread for connection with a gripping tag; the machine for making filter bags comprising:

a wheel defining a work surface; the wheel being rotational about a wheel axis to define a working path having a circular feed direction;

a first feed station configured for depositing individual tags, in phase, on the work surface in a depositing zone of the working path;

a second feed station configured for feeding, along a weave path, a thread on the work surface, starting from a further zone downstream of the depositing zone with reference to the feed direction of the wheel;

a third feed station configured for feeding a continuous strip of filter material on the work surface superposing the weave of thread and the tag, and positioned downstream relative to the second feed station with reference to the feed direction of the wheel;

a sealing device, positioned downstream of the first and second feed stations with reference to the feed direction of the wheel, and configured to provide seals between the thread, the tag and the strip of filter material;

a first feed device configured for moving the strip of filter material along a feed line, and positioned downstream of the wheel with reference to a feed direction of the strip of filter material;

a completion station configured for completing the filter bag equipped with the tag and the thread, the completion station positioned downstream of the first feed device with reference to the feed direction of the strip of filter material, and configured for forming the filter bag, for introducing a dose of infusion product in the filter bag formed and for closing the filter bag containing the dose of infusion product, wherein the first feed device comprises two first feed rollers configured for unwinding in a controlled manner, a quantity of the strip of filter material to be placed on the work surface of the wheel, the two first feed rollers being controlled by a control system for adjusting, via a motor, a speed of rotation of the two first feed rollers as a function of a length of the piece of filter material needed to form the filter bag of a desired size, and a transfer device configured for transversely moving the strip of filter material being fed, to modify a position of a centerline axis of the strip of filter material, such that the centerline axis coincides with a working line on the work surface of the wheel; the working line being parallel to the feed line and defined as a function of the desired size of the filter bag.

2. The machine according to claim 1, wherein the two first feed rollers are configured to operate with an alternating or step-by-step rotary movement.

3. The machine according to claim 1, and further comprising a second feed device configured for moving the strip of filter material, positioned between the first feed device and the completion station; the second feed device having two second rollers configured for feeding and positioning, in a controlled manner, the strip of filter material in the completion station.

4. The machine according to claim 3, wherein the two second rollers are configured to operate with a continuous rotary movement.

5. The machine according to claim 3, and further comprising a compensating device configured for modulating the feeding of the strip of filter material; the compensating device being positioned between the first feed device and the second feed device for modulating the feeding of the feed strip of material between the first feed device and the second feed device as a function of different speeds for feeding the strip of filter material of the first feed device and the second feed device.

6. The machine according to claim 1, wherein the transfer device comprises a transfer roller articulated to a unit for moving and intercepting the strip of filter material being fed, an angular rotation of the transfer roller being configured to modify a position of the centerline axis of the strip of filter material.

7. The machine according to claim 1, wherein the wheel has a prismatic shape such that the work surface defines a plurality of individual work surfaces in succession about the wheel axis; each individual work surface being flat in extension in such a way as to move, in sequence, to the individual first, second and third feed stations.

8. The machine according to claim 7, wherein the wheel has an octagonal shape, in cross section, to form eight individual work surfaces.

9. The machine according to claim 7, wherein each individual work surface has a plurality of projecting reference pins for defining the weave path of the thread.

10. The machine according to claim 1, wherein the sealing device comprises:

a first sealing device, positioned between the second feed station and the third feed station, and configured for making a first series of seals between the thread and the tag; and a second sealing device, positioned downstream of the first sealing device, with reference to the feed direction of the wheel, and configured for making a plurality of seals between a portion of the thread, positioned according to the weave path, and the strip of filter material, and between the strip of filter material and the tag.

11. The machine according to claim 10, wherein each first and second sealing device includes a respective single head for ultrasonic sealing, each acting on a corresponding portion of the work surface of the wheel.

12. The machine according to claim 1, wherein the control system is operatively connected with a memory on which is stored a plurality settings for a respective plurality of speeds of rotation of the two first feed rollers.

13. A machine for making filter bags for infusion products, the machine comprising:

a wheel having a work surface rotatable about an axis of rotation;

a filter feed station configured to feed a continuous strip of filter material on the work surface of the wheel;

a drawing device configured to advance the strip of filter material along a direction of advancement of the strip of filter material and arranged downstream of the wheel with reference to the direction of advancement of the strip of filter material;

a filter bag forming station arranged downstream of the drawing device with reference to the direction of advancement of the strip of filter material, and configured to introduce a dose of infusion product in the filter bag formed, and to close the filter bag containing the dose of infusion product, wherein the drawing device is configured to draw the strip of filter material at a speed which is a function of a length of the piece of filter material needed to form the filter bag of a desired size, and a transfer device for moving the strip of filter material transversely with respect to the direction of advancement of the strip of filter material in order to shift a position of a centerline axis of the strip of filter material such that the centerline axis of the strip of filter material coincides with a working line on the work surface of the wheel; the working line being parallel to the direction of advancement of the strip of filter material and defined as a function of the desired size of the filter bag.

* * * * *